US009265099B2

(12) United States Patent
Zheng et al.

(10) Patent No.: US 9,265,099 B2
(45) Date of Patent: Feb. 16, 2016

(54) POWER CONVERTER CIRCUIT FOR LOW POWER ILLUMINATION DEVICE, CONTROL CIRCUIT THEREOF AND METHOD THEREOF

(71) Applicant: Richtek Technology Corporation, Hsinchu (TW)

(72) Inventors: Gang Zheng, Guangdong (CN); Leng-Nien Hsiu, Hsinchu County (TW); Pei-Yuan Chen, Taoyuan County (TW)

(73) Assignee: RICHTEK TECHNOLOGY CORPORATION, Hsinchu (TW)

( * ) Notice: Subject to any disclaimer, the term of this patent is extended or adjusted under 35 U.S.C. 154(b) by 299 days.

(21) Appl. No.: 14/133,143

(22) Filed: Dec. 18, 2013

(65) Prior Publication Data

US 2014/0167647 A1 Jun. 19, 2014

(30) Foreign Application Priority Data

Dec. 18, 2012 (CN) ..... 2012 1 0552402

(51) Int. Cl.
*H05B 37/02* (2006.01)
*H05B 33/08* (2006.01)

(52) U.S. Cl.
CPC ..... *H05B 33/0803* (2013.01); *H05B 33/0815* (2013.01)

(58) Field of Classification Search
CPC ..... H05B 33/0815; H05B 33/0803; H05B 33/0848
See application file for complete search history.

(56) References Cited

U.S. PATENT DOCUMENTS

| | | | | |
|---|---|---|---|---|
| 8,106,601 | B2 | 1/2012 | Liu et al. | |
| 8,513,894 | B2 | 8/2013 | Huang et al. | |
| 8,653,751 | B2 * | 2/2014 | Shimizu | H05B 33/0815 315/299 |
| 2011/0043112 | A1 | 2/2011 | Brown et al. | |
| 2011/0068703 | A1 | 3/2011 | McKinney | |
| 2011/0068704 | A1 | 3/2011 | McKinney | |
| 2012/0169246 | A1 | 7/2012 | Eddeane et al. | |

FOREIGN PATENT DOCUMENTS

| | | | |
|---|---|---|---|
| CN | 101677483 | B | 11/2012 |
| CN | 202617462 | U | 12/2012 |
| TW | 200908808 | A | 2/2009 |
| TW | 200934300 | A | 8/2009 |

* cited by examiner

*Primary Examiner* — Hai L Nguyen
(74) *Attorney, Agent, or Firm* — Birch, Stewart, Kolasch & Birch, LLP

(57) ABSTRACT

A power converter circuit for a low power illumination device includes a boost converter circuit, a buck converter circuit, and a control circuit. The control circuit configures the boost converter circuit to alternately operate in a current conducting mode and an off mode, to draw different values of the current from an electric transformer in different periods in the current conducting mode, and to stop drawing current from the electric transformer in the off mode. The control circuit further configures the buck converter circuit to generate the required output signals to the low power illumination device according to the output of the boost converter circuit so that the low power illumination device may function normally.

21 Claims, 4 Drawing Sheets

POWER CONVERTER CIRCUIT FOR LOW POWER ILLUMINATION DEVICE, CONTROL CIRCUIT THEREOF AND METHOD THEREOF

CROSS-REFERENCE TO RELATED APPLICATIONS

This application claims the benefit of priority to Patent Application No. 201210552402.3, filed in China on Dec. 18, 2012; the entirety of which is incorporated herein by reference for all purposes.

BACKGROUND

The disclosure generally relates to a power converter circuit of an illumination system and, more particularly, to the power converter circuit with better compatibility.

In view of the awareness of the energy crisis and the promotion of the environmental protection, many traditional products with poor energy efficiency are gradually replaced by energy-saving products. For example, in the illumination system, low power illumination devices (e.g., light-emitting diodes) are usually utilized to replace traditional illumination devices (e.g., incandescent lamps and halogen lamps) to conserve energy.

Many low power illumination devices are manufactured in the form of standard bulbs or tubes to directly replace traditional bulbs or tubes. For example, light-emitting diodes may be made into T8 tubes, E27 bulbs, and MR16 lamps. It is, however, difficult to replace many circuit elements of the current illumination system already installed in the building (e.g., dimmers, electric transformers, and ballasts). If the traditional bulbs or tubes are directly replaced by the low power illumination devices, the low power illumination devices usually have problem cooperating with the circuit elements installed in the building. Therefore, the low power illumination device may flicker or may not be lighted up.

The electric transformers are so compact that they are usually utilized in the illumination system. The electric transformer comprises oscillating circuits and other circuit elements for providing the required voltage signal with a higher oscillating frequency. The load of the electric transformer must draw enough current to enable the normal operation of the electric transformer. The energy consumption of the low power illumination device, however, is usually far less than the energy consumption of the traditional illumination devices so that the low power illumination device may not draw enough current from the electric transformer. Consequently, the low power illumination device usually ma not function normally when cooperating with traditional circuit elements in the current illumination system.

U.S. Patent Application No. 2012/0169246A1 discloses an illumination device and a driving method to solve the aforementioned compatibility problem by alternately operating the circuit between a current generating mode and an off mode. Even if the technique in the aforementioned application is adopted, the compatibility problem still occurs when the low power illumination device cooperate with the electric transformer. The low power illumination device still may flicker or may not be lighted up.

SUMMARY

An example embodiment of a power converter circuit of an illumination system for coupling with an electric transformer through a rectifier circuit is disclosed; wherein the rectifier circuit generates a rectified voltage signal according to a conversion voltage signal provided by the electric transformer, and the power converter circuit supplies power to a low power illumination device according to the rectified voltage signal; comprising: a boost converter circuit, for coupling with the rectifier circuit, configured to operably generate a boost output signal according to the rectified voltage signal; a buck converter circuit, coupled with the boost converter circuit, configured to operably generate a buck output signal to supply power to the low power illumination device according to the boost output signal; and a control circuit, coupled with the boost converter circuit and the buck converter circuit, configured to operably configure the boost converter circuit to alternately operate in a current conducting mode and an off mode so that the boost converter circuit draws current from the electric transformer in the current conducting mode and stops drawing current from the electric transformer in the off mode; wherein a signal value of the boost output signal is greater than a signal value of the rectified voltage signal; a signal value of the buck output signal is less than the signal value of the boost output signal; the control circuit configures the boost converter circuit to draw a first current in a first period in the current conducting mode before drawing a second current in a second period in the current conducting mode; and the first current drawn in the first period is greater than the second current drawn in the second period.

Another example embodiment of a control circuit of a power converter circuit of an illumination system is disclosed; wherein the illumination system comprises an electric transformer, a rectifier circuit, a boost converter circuit and a buck converter circuit; the electric transformer generates a conversion voltage signal according to an input voltage signal; the rectifier circuit is coupled with the electric transformer for generating a rectified voltage signal according to the conversion voltage signal; the boost converter circuit is coupled with the rectifier circuit for generating a boost output signal according to the rectified voltage signal; the buck converter circuit is coupled with the boost converter circuit for generating a buck output signal according to the boost output signal so as to supply power to a low power illumination device; and the control circuit of the power converter circuit is configured to operably couple with the boost converter circuit and the buck converter circuit; comprising: a first reference voltage generating circuit, configured to operably generate a first reference voltage signal; a first comparator circuit, configured to operably generate a first control signal for configuring a conducting status of a first switch of the boost converter circuit according to a first sensing signal of the boost converter circuit and the first reference voltage signal; a second reference voltage generating circuit, configured to operably generate a second reference voltage signal; a second comparator circuit, configured to operably generate a second control signal for configuring a conducting status of a second switch of the buck converter circuit according to a second sensing signal of the buck converter circuit and the second reference voltage signal; a third comparator circuit, configured to operably compare the boost output signal with a first predetermined voltage, and to operably stop outputting the first control signal to the boost converter circuit when the boost output signal is greater than the first predetermined voltage so that the boost converter circuit operates in an off mode; a fourth comparator circuit, configured to operably compare the boost output signal with a second predetermined voltage, and to operably configure the first control signal to be outputted to the boost converter circuit when the boost output signal is less than the second predetermined voltage so that the boost converter circuit operates in a current conducting mode; and a mode control circuit, configured to operably configure the first reference voltage generating circuit to adjust the first reference voltage signal so that the boost converter circuit draws a first current in a first period in the current conducting mode before drawing a second current in a second period in the current conducting mode; wherein the first current drawn in the first period is greater than the second current drawn in the second period; a signal value of the boost output signal is greater than a signal value of the rectified voltage signal; and a signal value of the buck output signal is less than the signal value of the boost output signal.

Another example embodiment of a method for configuring a power converter circuit of an illumination system is disclosed; wherein the illumination system comprises an electric transformer, a rectifier circuit, a boost converter circuit and a buck converter circuit; the electric transformer generates a conversion voltage signal according to an input voltage signal; the rectifier circuit is coupled with the electric transformer for generating a rectified voltage signal according to the conversion voltage signal; the boost converter circuit is coupled with the rectifier circuit for generating a boost output signal according to the rectified voltage signal; the buck converter circuit is coupled with the boost converter circuit for generating a buck output signal according to the boost output signal, so as to supply power to a low power illumination device; comprising: generating a first reference voltage signal and a second reference voltage signal; generating a first control signal according to a first sensing signal of the boost converter circuit and the first reference voltage signal; generating a second control signal for configuring a conducting status of a second switch of the buck converter circuit according to a second sensing signal of the buck converter circuit and the second reference voltage signal; comparing the boost output signal with a second predetermined voltage; configuring the boost converter circuit to operate in a current conducting mode when the boost output signal is less than the second predetermined voltage, and configuring the boost converter circuit to draw a first current in a first period in the current conducting mode before drawing a second current in a second period in the current conducting mode; comparing the boost output signal with a first predetermined voltage; and configuring the boost converter circuit to operate in an off mode when the boost output signal is greater than the first predetermined voltage; wherein a signal value of the boost output signal is greater than a signal value of the rectified voltage signal; a signal value of the buck output signal is less than the signal value of the boost output signal; and the first current drawn in the first period is greater than the second current drawn in the second period.

Both the foregoing general description and the following detailed description are examples and explanatory only, and are not restrictive of the invention as claimed.

DETAILED DESCRIPTION

Reference is made in detail to embodiments of the invention, which are illustrated in the accompanying drawings. The same reference numbers may be used throughout the drawings to refer to the same or like parts, components, or operations.

Figure 1:
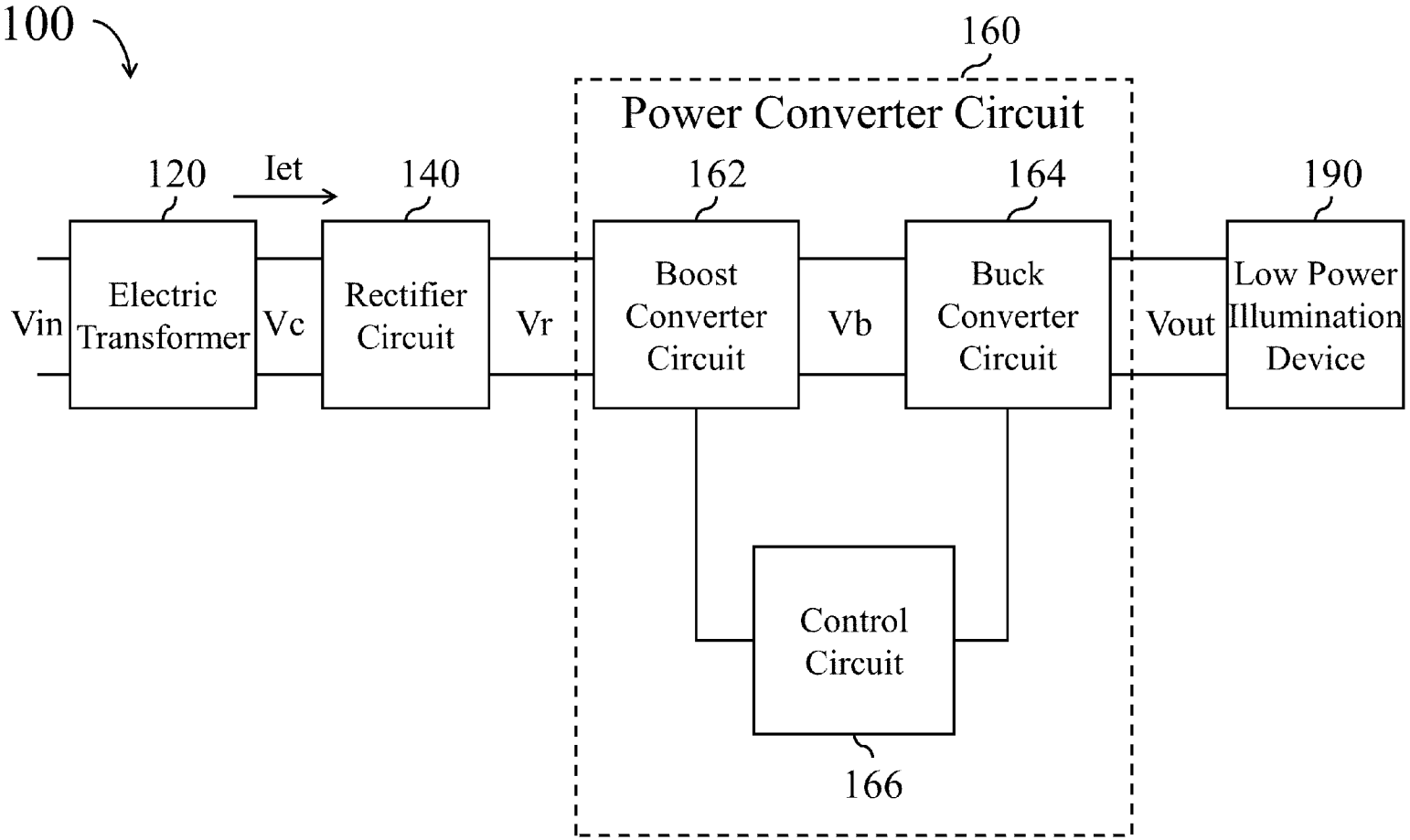
FIG. 1 shows a simplified functional block diagram of an illumination system according to one embodiment of the present disclosure.

FIG. 1 shows a simplified functional block diagram of an illumination system 100 according to one embodiment of the present disclosure. The illumination system 100 comprises an electric transformer 120, a rectifier circuit 140, a power converter circuit 160 and a low power illumination device 190. For the purposes of conciseness and clear explanation, other components and connections of the illumination system 100 are not shown in FIG. 1. For example, the illumination system 100 may comprise a dimmer so that a user may adjust the required brightness.

In this embodiment, the electric transformer 120 comprises an oscillating circuit (not shown in FIG. 1) for generating a conversion voltage signal Vc according to an input voltage signal Vin. The electric transformer 120 may transform the input voltage signal Vin into the conversion voltage signal Vc with higher frequency. For example, the electric transformer 120 may transform a 110 volt (V), 60 Hertz (Hz) alternating current (AC) signal into a 12 V, 40,000 Hz AC signal.

The rectifier circuit 140 is coupled between the electric transformer 120 and the power converter circuit 160. The rectifier circuit 140 may rectify the conversion voltage signal Vc for generating a rectified voltage signal Vr provided to the power converter circuit 160. For example, the rectifier circuit 140 may be realized with a full bridge rectifier circuit, a half bridge rectifier circuit, etc.

In this embodiment, the power converter circuit 160 comprises a boost converter circuit 162, a buck converter circuit 164 and a control circuit 166.

The boost converter circuit 162 generates a boost output signal Vb according to the rectified voltage signal Vr, and a signal value of the boost output signal Vb is greater than a signal value of the rectified voltage signal Vr. The boost converter circuit 162 may be realized with any suitable circuit structures for configuring the signal value of the boost output signal Vb to be greater than the signal value of the rectified voltage signal Vr.

The buck converter circuit 164 generates a buck output signal Vout according to the boost output signal Vb, and a signal value of the buck output signal Vout is less than the signal value of the boost output signal Vb. The buck converter circuit 164 may be realized with any suitable circuit structures for configuring the signal value of the buck output signal Vout to be less than the signal value of the boost output signal Vb.

The control circuit 166 is coupled with the boost converter circuit 162 and the buck converter circuit 164 for configuring the operations of the boost converter circuit 162 and the buck converter circuit 164. Therefore, the illumination system 100 may provide the required illuminating function.

Compared with the power consumption of traditional illumination devices (e.g., incandescent lamps and halogen lamps) consuming tens of watts (W), the low power illumination devices 190 usually consume 10 W or less for the same amount of brightness. For example, the low power illumination device 190 may be realized with one or more light-emitting diodes or other suitable low power consumption illumination devices.

In many illumination systems, the electric transformer 120 usually requires a minimum load current Imin and/or a minimum load frequency to operate normally. Namely, a current Iet drawn from the electric transformer 120 must greater than the minimum load current Imin, and/or the frequency of the current Iet must be greater than the minimum load frequency so that the electric transformer 120 may operate normally for providing the required conversion voltage signal Vc.

The power consumption of the low power illumination device 190, however, is usually far less than the traditional illumination device. The low power illumination device 190 cannot draw enough current let from the electric transformer 120 in the traditional way. Consequently, the electric transformer 120 may not operate normally and the low power illumination device 190 may flicker or may not be lighted up.

The control circuit 166 may configure the boost converter circuit 162 to draw current from the electric transformer 120 in an appropriate way so that the electric transformer 120 may operate normally. The control circuit 166 may also configure the buck converter circuit 164 to steadily provide the buck voltage signal Vout to the low power illumination device 190. Therefore, the compatibility problem of the low power illumination device 190 may be solved, and the low power illumination device 190 may provide the required illuminating and dimming function.

Figure 2:
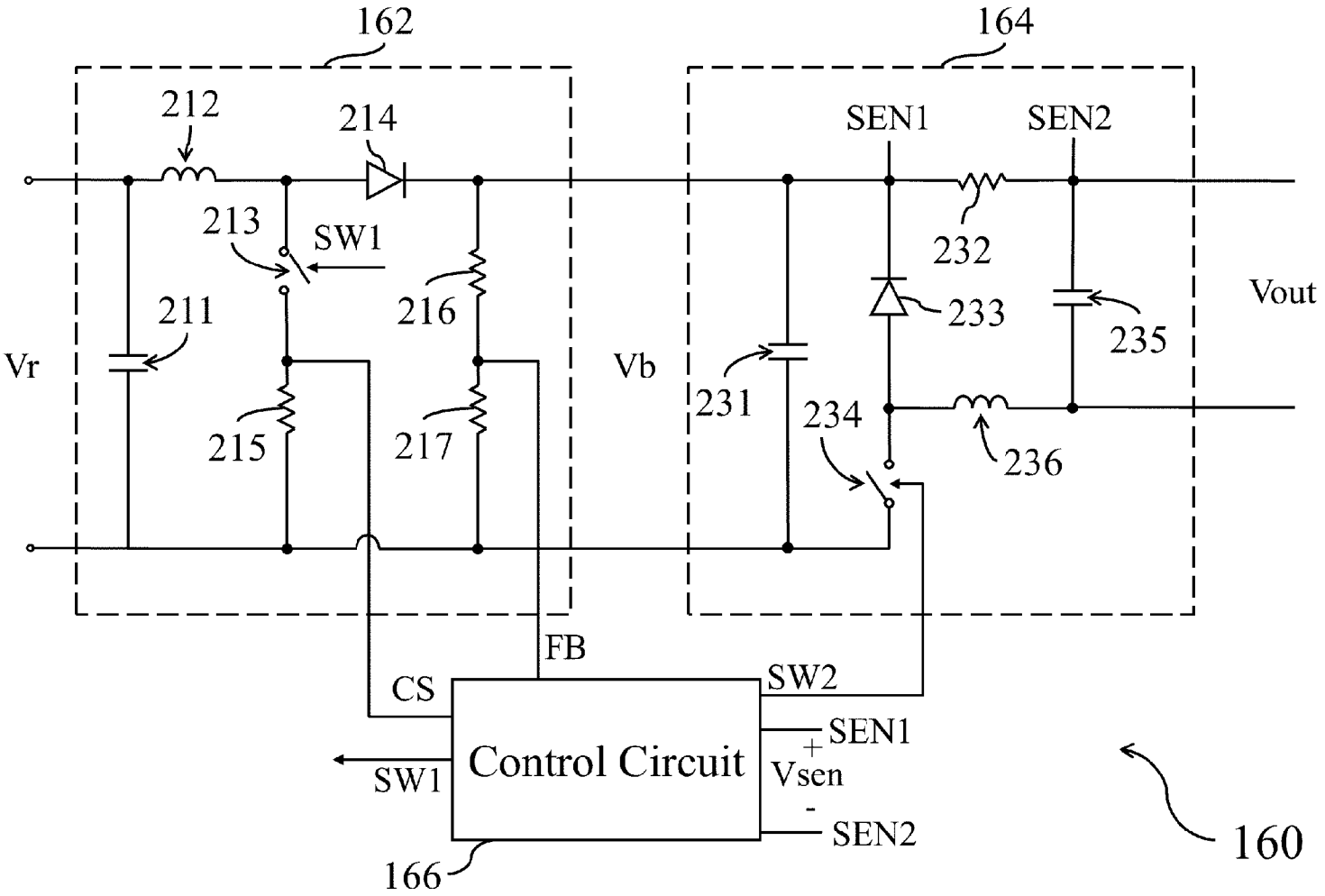
FIG. 2 shows a simplified circuit diagram of the power converter circuit in FIG. 1 according to one embodiment of the present disclosure.

FIG. 2 shows a simplified circuit diagram of a power converter circuit 160 of FIG. 1 according to one embodiment of the present disclosure. The operations of the illumination system 100 will be further explained below by reference to FIGS. 1-2.

In the embodiment in FIG. 2, the boost converter circuit 162 comprises a first capacitor 211, a first inductor 212, a first switch 213, a first diode 214, a first resistor 215, a second resistor 216 and a third resistor 217. The first switch 213 may be realized with a transistor, etc.

The first capacitor 211 is coupled with the output terminal of the rectifier circuit 140 to receive the rectified voltage signal Vr. The first terminal of the first inductor 212 is coupled with the first terminal of the first capacitor 211. The second terminal of the first inductor 212 is coupled with the first terminal of the first switch 213 and the first terminal of the first diode 214. The second terminal of the first switch 213 is coupled with the first terminal of the first resistor 215. The second terminal of the first diode 214 is coupled with the first terminal of the second resistor 216. The second terminal of the second resistor 216 is coupled with the first terminal of the third resistor 217. Moreover, the second terminal of the first resistor 215 and the second terminal of the third resistor 217 are coupled with the second terminal of the first capacitor 211.

The control circuit 166 may configure a conducting status of the first switch 213 by using a first control signal SW1 so that the boost converter circuit 162 generates the required boost voltage signal Vb according to the rectified voltage signal Vr. For example, the control circuit 166 may generate the first control signal SW1 according to a first sensing signal CS of the boost converter circuit 162 so as to intermittently conduct the first switch 213. Consequently, a signal value between the first terminal of the second resistor 216 and the second terminal of the third resistor 217 (i.e., the signal value of the boost voltage signal Vb) is greater than the signal value of the rectified voltage signal Vr. The signal between the first terminal of the second resistor 216 and the second terminal of the third resistor 217 is outputted as the boost voltage signal Vb.

The boost voltage signal Vb is divided by the second resistor 216 and the third resistor 217 to generate a feedback signal FB. The control circuit 166 may also configure the conducting time, the conducting frequency and the conducting status of the first switch 213 according to the feedback signal FB so that the boost converter circuit 162 may provide the required boost voltage signal Vb.

In the embodiment in FIG. 2, the buck converter circuit 164 comprises a second capacitor 231, a fourth resistor 232, a second diode 233, a second switch 234, a third capacitor 235, and a second inductor 236. The second switch 234 may be realized with a transistor, etc.

The first terminal of the second capacitor 231 is coupled with the first terminal of the fourth resistor 232 and the first terminal of the second diode 233. The second terminal of the second diode 233 is coupled with the first terminal of the second switch 234. The second terminal of the second switch 234 is coupled with the second terminal of the second capacitor 231. The second terminal of the fourth resistor 232 is coupled with the first terminal of the third capacitor 235. The second inductor 236 is coupled between the second terminal of the second diode 233 and the second terminal of the third capacitor 235.

The control circuit 166 may configure a conducting status of the second switch 234 by using a second control signal SW2 so that the buck converter circuit 164 may generate the required buck voltage signal Vout according to the boost voltage signal Vb. For example, in this embodiment, the control circuit 166 may generate the second control signal SW2 according to the second sensing signal Vsen between two terminals SEN1 and SEN2 of the fourth resistor 232 so as to intermittently conduct the second switch 234. Consequently, a signal value between the first terminal and the second terminal of the third capacitor 235 (i.e., the signal value of the buck voltage signal Vout) is less that the signal value of the boost voltage signal Vb. The signal value between the first terminal and the second terminal of the third capacitor 235 is outputted as the buck voltage signal Vout so as to supply power to the low power illumination device 190.

In one preferred embodiment, the signal value of the buck voltage signal Vout is greater than a minimum load voltage Vmin of the low power illumination device 190 so as to prevent the low power illumination device 190 from flickering. The minimum load voltage Vmin is the minimum voltage to prevent the low power illumination device 190 from flicking. For example, when the low power illumination device 190 comprises three light-emitting diodes each with a 1.5V conducting voltage, the minimum load voltage Vmin of the low power illumination device 190 is 4.5V. Therefore, the control circuit 166 configures the buck voltage signal Vout provided by the buck converter circuit 164 to be greater than 4.5V.

Figure 3:
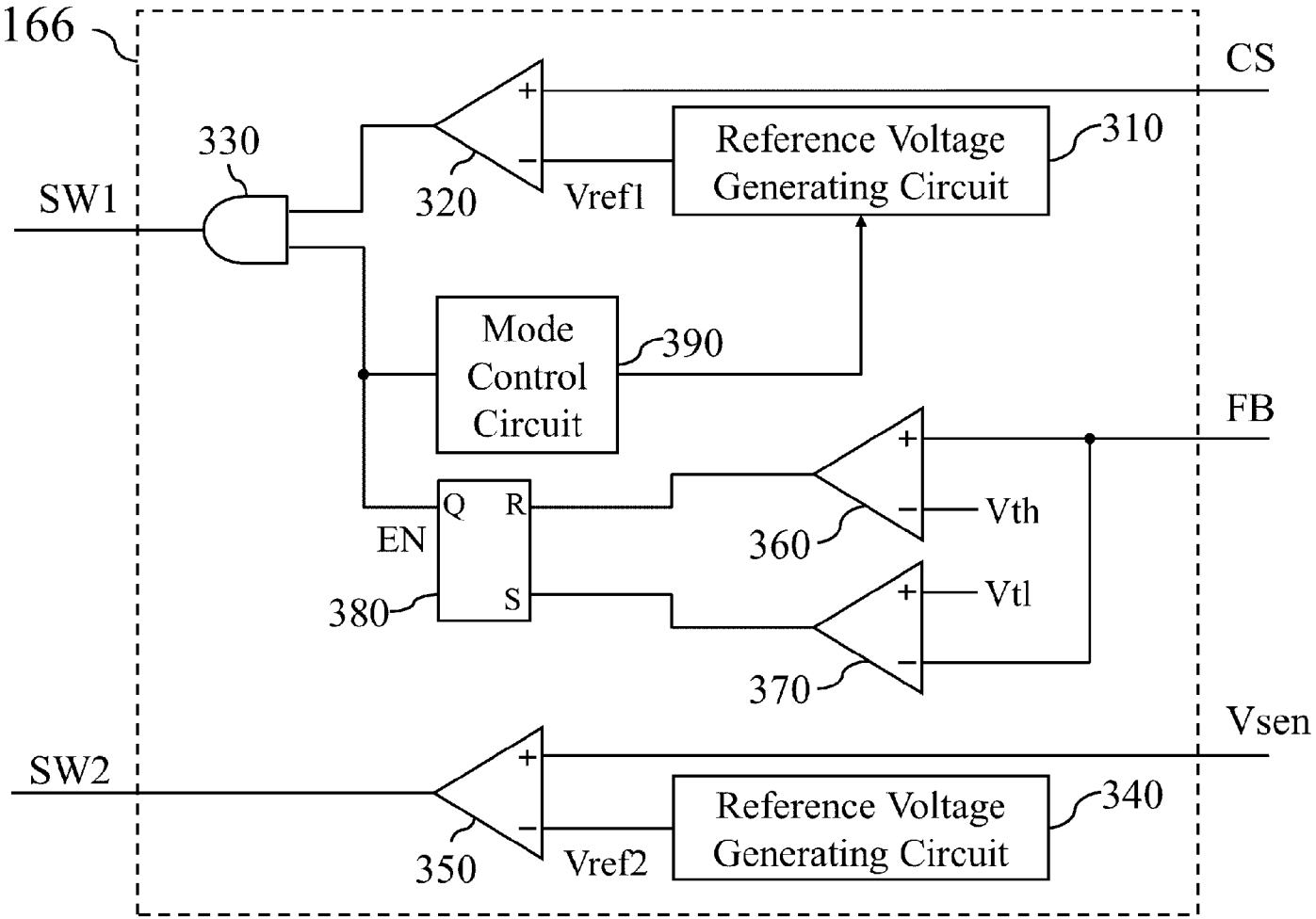
FIG. 3 shows a simplified circuit diagram of the control circuit of the power converter circuit in FIG. 1 according to one embodiment of the present disclosure.

FIG. 3 shows a simplified circuit diagram of a control circuit 166 of the power converter circuit 160 according to one embodiment of the present disclosure. The operations of the illumination system 100 will be further explained below by reference to FIGS. 1-3.

In the embodiment in FIG. 3, the control circuit 166 comprises a first reference voltage generating circuit 310, a first comparator circuit 320, an AND gate 330, a second reference voltage generating circuit 340, a second comparator circuit 350, a third comparator circuit 360, a fourth comparator circuit 370, an SR flip flop 380 and a mode control circuit 390.

The first reference voltage generating circuit 310 is configured to operably generate a first reference voltage signal Vref1. The first comparator circuit 320 compares the reference voltage signal Vref1 with the first sensing signal CS of the boost converter circuit 162 to generate the first control signal SW1 so as to configure the conducting status of the first switch 213. In the embodiment in FIG. 2, a terminal of the control circuit 166 is coupled between the first switch 213 and the first resistor 215, and the signal between the first switch 213 and the first resistor 215 is taken as the first sensing signal CS. The second reference voltage generating circuit 340 is configured to operably generate a second reference voltage signal Vref2. The second comparator circuit 350 compares the reference voltage signal Vref2 with the second sensing signal Vsen of the buck converter circuit 164 to generate the second control signal SW2 so as to configure the conducting status of the second switch 234. The third comparator circuit 360 and the fourth comparator circuit 370 respectively compare the feedback signal FB with a first predetermined voltage Vth and a second predetermined voltage Vt1, and the comparison results are respectively transmitted to the reset terminal R and the set terminal S of the SR flip flop 380. When the feedback signal FB is less than the second predetermined voltage Vt1, a control signal EN at the output terminal Q of the SR flip flop 380 is configured to be high. When the feedback signal FB is greater than the first predetermined voltage Vth, the control signal EN at the output terminal Q of the SR flip flop 380 is configured to be low.

The first AND gate 330 performs the "AND" operation on the output signal of the first comparator circuit 320 and the control signal EN outputted from the SR flip flop 380 to generate the first control signal SW1 for configuring the operation of the boost converter circuit 162. Accordingly, the boost converter circuit 162 may draw current from the electric transformer 120 in an appropriate way. When the feedback signal FB is greater than the first predetermined voltage Vth, the AND gate 330 performs the "AND" operation on the output signal of the first comparator 320 and the control signal EN (which is low), and the generated first control signal SW1 is configured to be low so that the first switch 213 is turned off. Therefore, the boost converter circuit 162 operates in the off mode. When the feedback signal FB is less than the second predetermined voltage Vt1, the AND gate 330 performs the "AND" operation on the output signal of the first comparator 320 and the control signal EN (which is high) to generate the first control signal SW1, and the conduction status of the first switch 213 may be configured according to the first control signal SW1. Therefore, the boost converter circuit 162 operates in the current conducting mode. Accordingly, the control circuit 166 may configure the operation of the boost converter circuit 162 according to the signal value of the feedback signal FB.

The mode control circuit 390 configures the first reference voltage generating circuit 310 to configure the reference voltage signal Vref1 according to the control signal EN provided by the SR flip flop 380. Therefore, the first comparator circuit 320 and the first AND gate 330 may generate the required first control signal SW1.

Figure 4:
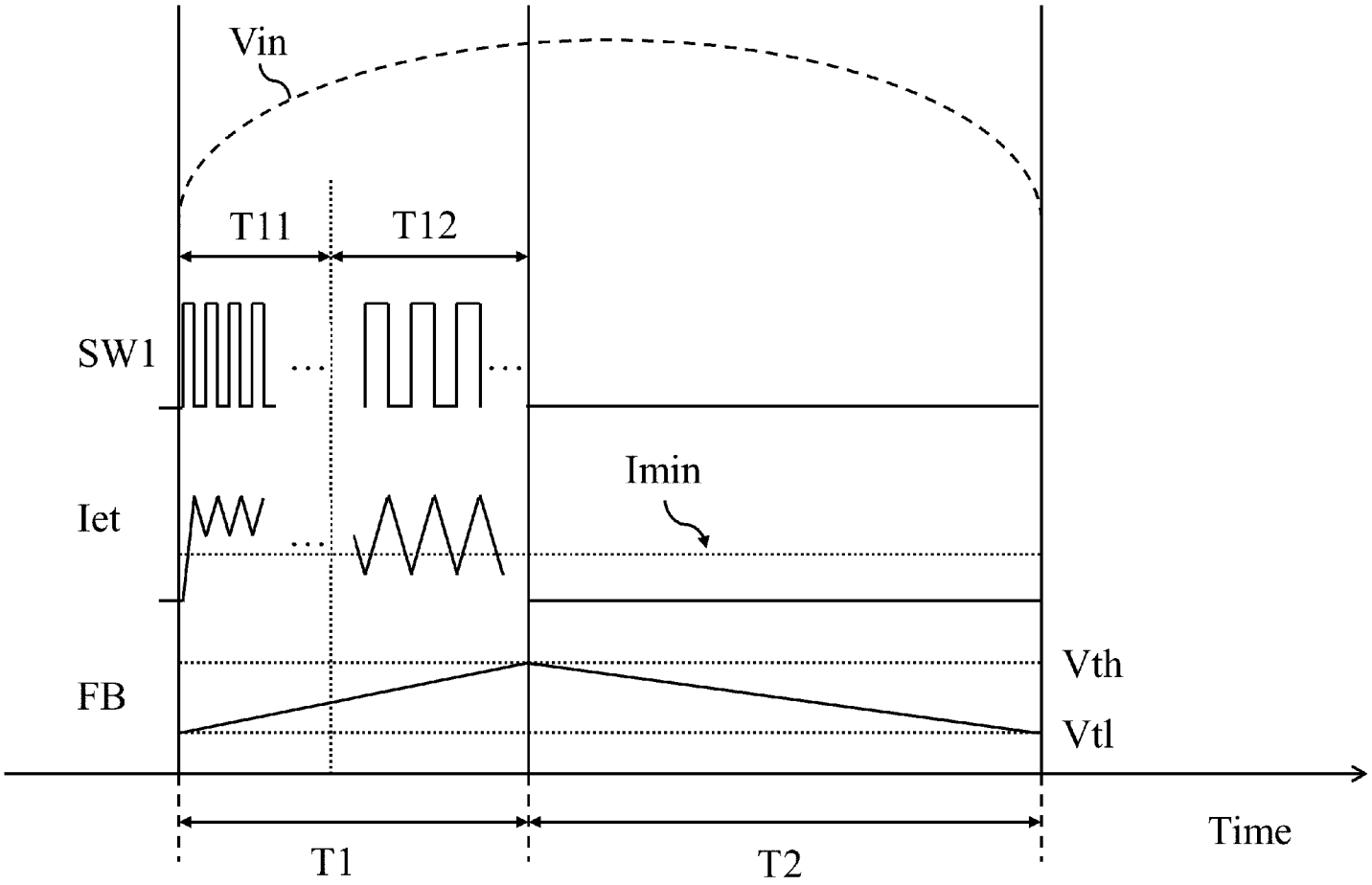
FIG. 4 shows a simplified timing diagram of several signals generated by the illumination system in FIG. 1 according to one embodiment of the present disclosure.

FIG. 4 shows a simplified timing diagram of several signals generated by the illumination system 100 according to one embodiment of the present disclosure. The operations of the illumination system 100 will be further explained below by reference to FIGS. 1-4.

The embodiment in FIG. 4 shows the waveform of a portion of the input voltage signal Vin. In FIG. 4, the control circuit 166 configures the boost converter circuit 162 to operate in the current conducting mode in a period T1, and to operate in the off mode in a period T2.

Accordingly, the boost converter circuit 162 may draw enough current from the electric transformer 120 so that the electric transformer 120 may operate normally in the period T1. Because the boost converter circuit 162 has drawn enough current from the electric transformer 120 in the period T1, the boost converter circuit 162 stops drawing current from the electric transformer 120 in the period T2 to reduce the power consumption. Moreover, in the periods T1 and T2, the control circuit 166 configures the buck converter circuit 164 to steadily supply power to the low power illumination device 190 according to the current drawn by boost converter circuit 162 in the period T1. Therefore, the low power illumination device 190 may continuously and steadily provide the required illuminating function.

When the feedback signal FB is less than the second predetermined voltage Vt1, the control circuit 166 configures the boost converter circuit 162 to draw the current from the electric transformer 120. Accordingly, in the embodiment in FIG. 3, the output signal of the fourth comparator circuit 370 is configured to be high so that the SR flip flop 380 configures the control signal EN to be high. Thus, the control circuit 166 may configure the conduction status of the first switch 213 of the boost converter circuit 162 according to the first control signal SW1.

In order to further improve the compatibility of the electric transformer 120 and the low power illumination device 190, the control circuit 166 may configure the boost converter circuit 162 to draw the current from the electric transformer 120 in at least two modes in the period T1 in the current conducting mode. In the embodiment in FIG. 4, the control circuit 166 configures the boost converter circuit 162 to respectively draw different currents from the electric transformer 120 in a first period T11 and a second period T12 of the period T1. Moreover, the control circuit 166 configures the boost converter circuit 162 to draw a first current in the first period T11, which is greater than a second current drawn in the second period T12.

In the embodiment in FIG. 4, the mode control circuit 390 may configure the first reference voltage generating circuit 310 to configure the reference voltage signal Vref1 Therefore, the first comparator circuit 320 and the first AND gate 330 may generate the required first control signal SW1 for configuring the first switch 213 so that the boost converter circuit 162 may draw different currents from the electric transformer 120 in different periods.

The mode control circuit 390 may configure the first reference voltage generating circuit 310 to configure a signal value of the reference voltage signal Vref1. Thus, the current drawn from the electric transformer 120 by the boost converter circuit 162 in the first period T11 according to the first control signal SW1 is greater than the current drawn from the electric transformer 120 by the boost converter circuit 162 in the second period T12 according to the first control signal SW1.

For example, in one embodiment, the control circuit 166 configures a minimum value of the current Jet drawn from the electric transformer 120 by the boost converter circuit 162 in the first period T11 to be greater than a minimum value of the current Iet drawn from the electric transformer 120 by the boost converter circuit 162 in the second period T12.

In other embodiments, the control circuit 166 configures a maximum value of the current Iet drawn from the electric transformer 120 by the boost converter circuit 162 in the first period T11 to be greater than a maximum value of the current Iet drawn from the electric transformer 120 by the boost converter circuit 162 in the second period T12.

In other embodiments, the control circuit 166 may also configure the frequency, the duty cycle, the conducting time, and the off time of the first control signal SW1. Therefore, the current Iet drawn from the electric transformer 120 by the boost converter circuit 162 in the first period T11 is greater than the current Jet drawn from the electric transformer 120 by the boost converter circuit 162 in the second period T12.

In the aforementioned embodiments, the control circuit 166 may configure the frequency, the duty cycle, the conducting time, and the off time of the first control signal SW1 to be the suitable value(s) in different time period. Therefore, a maximum value and a minimum value of the current Iet may be respectively maintained at the required value within the required time period. For example, the control circuit 166 may configure the first control signal SW1 in two or more time periods. Moreover, in the aforementioned embodiments, the control circuit 166 may also configure the frequency, the duty cycle, the conducting time, and the off time of the first control signal SW1 in a continuous manner so that the maximum value and the minimum value of the current Iet may be continuously changed.

In the embodiment in FIG. 4, the boost converter circuit 162 has drawn enough current from the electric transformer 120 in the first period T11 for the normal operation of the electric transformer 120. Accordingly, the minimum value of the current Iet drawn from the electric transformer 120 by the boost converter circuit 162 in the second period T12 may be configured to be less than the minimum load current Imin of the electric transformer 120. In this situation, the electric transformer 120 may not only operate normally, but also reduce the limitation of hardware design and conserve energy.

In other embodiments, the control circuit 166 may configure the minimum value of the current Iet drawn from the electric transformer 120 by the boost converter circuit 162 in the first period T11 to be less than the minimum load current Imin of the electric transformer 120.

When the feedback signal FB is greater than the first predetermined voltage Vth, the control circuit 166 configures the boost converter circuit 162 to stop drawing the current from the electric transformer 120. Accordingly, in the embodiment in FIG. 3, the output signal of the third comparator circuit 360 is configured to be high so that the SR flip flop 380 configures the control signal EN to be low. The output signal of the control circuit 166 is configured to be low so that the first switch 213 of the boost converter circuit 162 is turned off and the boost converter circuit 162 stops drawing the current from the electric transformer 120.

In the aforementioned embodiments, each functional block may be realized with one or more circuit components, or multiple functional blocks may be integrated in one circuit component appropriately. For example, the power converter circuit 160 and the low power illumination device 190 in FIG. 1 may be arranged together in a bulb or a tube, and may be connected with other circuit components through appropriate terminals (not shown in FIG. 1)

In the aforementioned embodiments, the power converter circuit 160 is realized with only a boost converter circuit 162 and a buck converter circuit 164. In other embodiments, the power converter circuit 160 may be realized with one or more boost converter circuits, one or more buck converter circuits, and/or one or more buck-boost converter circuits. Therefore, the voltage outputted to the low power illumination device 190 may be configured to be greater than the minimum load voltage of the low power illumination device 190.

In the aforementioned embodiments, the signal and relative functional blocks are explained in the active high manner for the purposes of conciseness and clear explanation. In other embodiments, each functional block and each signal may be respectively realized with the active high manner or the active low manner according to different design considerations.

In the aforementioned embodiments, the power converter circuit of the illumination system may operate in two or more operating modes. In the current conducting mode, the boost converter circuit of the power converter circuit may draw enough current from the electric transformer so that the electric transformer may operate normally. In the off mode, the boost converter circuit of the power converter circuit may stop drawing current from the electric transformer to conserve energy. Moreover, the buck converter circuit of the power converter circuit may steadily supply power to the low power illumination device according to the boost voltage signal of the boost converter circuit. Therefore, the low power illumination device may steadily provide the illuminating function.

Moreover, in the current conducting mode, the control circuit of the power converter circuit may configure the boost converter circuit to draw a larger current from the electric transformer for rapidly entering the normal operation mode. Afterward, the control circuit configures the boost converter circuit to draw a smaller current from the electric transformer to reduce the power consumption. The control circuit of the power converter circuit may configure the boost converter circuit to draw current form the electric transformer in two or more operation mode so that the electric transformer and the low power illumination device may cooperate better to solve the compatibility problem.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The phrases "be coupled with," "couples with," and "coupling with" are intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

The term "and/or" may comprise any and all combinations of one or more of the associated listed items. In addition, the singular forms "a," "an," and "the" herein are intended to comprise the plural forms as well, unless the context clearly indicates otherwise.

Other embodiments of the invention will be apparent to those skilled in the art from consideration of the specification and practice of the invention disclosed herein. It is intended that the specification and examples be considered as exemplary only, with a true scope and spirit of the invention indicated by the following claims.

What is claimed is:

1. A power converter circuit of an illumination system, for coupling with an electric transformer through a rectifier circuit; wherein the rectifier circuit generates a rectified voltage signal according to a conversion voltage signal provided by the electric transformer, and the power converter circuit supplies power to a low power illumination device according to the rectified voltage signal; comprising:

a boost converter circuit, for coupling with the rectifier circuit, configured to operably generate a boost output signal according to the rectified voltage signal;

a buck converter circuit, coupled with the boost converter circuit, configured to operably generate a buck output signal to supply power to the low power illumination device according to the boost output signal; and a control circuit, coupled with the boost converter circuit and the buck converter circuit, configured to operably configure the boost converter circuit to alternately operate in a current conducting mode and an off mode so that the boost converter circuit draws current from the electric transformer in the current conducting mode and stops drawing current from the electric transformer in the off mode;

wherein a signal value of the boost output signal is greater than a signal value of the rectified voltage signal; a signal value of the buck output signal is less than the signal value of the boost output signal; the control circuit configures the boost converter circuit to draw a first current in a first period in the current conducting mode before drawing a second current in a second period in the current conducting mode; and the first current drawn in the first period is greater than the second current drawn in the second period.

2. The power converter circuit of claim 1, wherein a minimum value of the first current drawn in the first period is greater than a minimum value of the second current drawn in the second period.

3. The power converter circuit of claim 1, wherein a maximum value of the first current drawn in the first period is greater than a maximum value of the second current drawn in the second period.

4. The power converter circuit of claim 1, wherein a minimum value of the second current drawn in the second period is less than a minimum load current of the electric transformer.

5. The power converter circuit of claim 1, wherein a minimum value of the first current drawn in the first period is less than a minimum load current of the electric transformer.

6. The power converter circuit of claim 1, wherein when the boost converter circuit operates in the current conducting mode, if the boost output signal is greater than a first predetermined voltage, the control circuit configures the boost converter circuit to operate in the off mode.

7. The power converter circuit of claim 1, wherein when the boost converter circuit operates in the off mode, if the boost output signal is less than a second predetermined voltage, the control circuit configures the boost converter circuit to operate in the current conducting mode.

8. A control circuit of a power converter circuit of an illumination system; wherein the illumination system comprises an electric transformer, a rectifier circuit, a boost converter circuit and a buck converter circuit; the electric transformer generates a conversion voltage signal according to an input voltage signal; the rectifier circuit is coupled with the electric transformer for generating a rectified voltage signal according to the conversion voltage signal; the boost converter circuit is coupled with the rectifier circuit for generating a boost output signal according to the rectified voltage signal; the buck converter circuit is coupled with the boost converter circuit for generating a buck output signal according to the boost output signal so as to supply power to a low power illumination device; and the control circuit of the power converter circuit is configured to operably couple with the boost converter circuit and the buck converter circuit; comprising:

a first reference voltage generating circuit, configured to operably generate a first reference voltage signal;

a first comparator circuit, configured to operably generate a first control signal for configuring a conducting status of a first switch of the boost converter circuit according to a first sensing signal of the boost converter circuit and the first reference voltage signal;

a second reference voltage generating circuit, configured to operably generate a second reference voltage signal;

a second comparator circuit, configured to operably generate a second control signal for configuring a conducting status of a second switch of the buck converter circuit according to a second sensing signal of the buck converter circuit and the second reference voltage signal;

a third comparator circuit, configured to operably compare the boost output signal with a first predetermined voltage, and to operably stop outputting the first control signal to the boost converter circuit when the boost output signal is greater than the first predetermined voltage so that the boost converter circuit operates in an off mode;

a fourth comparator circuit, configured to operably compare the boost output signal with a second predetermined voltage, and to operably configure the first control signal to be outputted to the boost converter circuit when the boost output signal is less than the second predetermined voltage so that the boost converter circuit operates in a current conducting mode; and a mode control circuit, configured to operably configure the first reference voltage generating circuit to adjust the first reference voltage signal so that the boost converter circuit draws a first current in a first period in the current conducting mode before drawing a second current in a second period in the current conducting mode;

wherein the first current drawn in the first period is greater than the second current drawn in the second period; a signal value of the boost output signal is greater than a signal value of the rectified voltage signal; and a signal value of the buck output signal is less than the signal value of the boost output signal.

9. The control circuit of claim 8, wherein the mode control circuit configures a minimum value of the first current drawn in the first period greater than a minimum value of the second current drawn in the second period.

10. The control circuit of claim 8, wherein the mode control circuit configures a maximum value of the first current drawn in the first period greater than a maximum value of the second current drawn in the second period.

11. The control circuit of claim 8, wherein the mode control circuit configures a minimum value of the second current drawn in the second period to be less than a minimum load current of the electric transformer.

12. The control circuit of claim 8, wherein the mode control circuit configures a minimum value of the first current drawn in the first period to be less than a minimum load current of the electric transformer.

13. The control circuit of claim 8, wherein when the boost converter circuit operates in the current conducting mode, if the boost output signal is greater than the first predetermined voltage, the mode control circuit configures the boost converter circuit to operate in the off mode.

14. The control circuit of claim 8, wherein when the boost converter circuit operates in the off mode, if the boost output signal is less than the second predetermined voltage, the mode control circuit configures the boost converter circuit to operate in the current conducting mode.

15. A method for configuring a power converter circuit of an illumination system; wherein the illumination system comprises an electric transformer, a rectifier circuit, a boost converter circuit and a buck converter circuit; the electric transformer generates a conversion voltage signal according to an input voltage signal; the rectifier circuit is coupled with the electric transformer for generating a rectified voltage signal according to the conversion voltage signal; the boost converter circuit is coupled with the rectifier circuit for generating a boost output signal according to the rectified voltage signal; the buck converter circuit is coupled with the boost converter circuit for generating a buck output signal according to the boost output signal, so as to supply power to a low power illumination device; comprising:

generating a first reference voltage signal and a second reference voltage signal;

generating a first control signal according to a first sensing signal of the boost converter circuit and the first reference voltage signal;

generating a second control signal for configuring a conducting status of a second switch of the buck converter circuit according to a second sensing signal of the buck converter circuit and the second reference voltage signal;

comparing the boost output signal with a second predetermined voltage;

configuring the boost converter circuit to operate in a current conducting mode when the boost output signal is less than the second predetermined voltage, and configuring the boost converter circuit to draw a first current in a first period in the current conducting mode before drawing a second current in a second period in the current conducting mode;

comparing the boost output signal with a first predetermined voltage; and configuring the boost converter circuit to operate in an off mode when the boost output signal is greater than the first predetermined voltage;

wherein a signal value of the boost output signal is greater than a signal value of the rectified voltage signal; a signal value of the buck output signal is less than the signal value of the boost output signal; and the first current drawn in the first period is greater than the second current drawn in the second period.

16. The method of claim 15, wherein a minimum value of the first current drawn in the first period is greater than a minimum value of the second current drawn in the second period.

17. The method of claim 15, wherein a maximum value of the first current drawn in the first period is greater than a maximum value of the second current drawn in the second period.

18. The method of claim 15, wherein a minimum value of the second current drawn in the second period is less than a minimum load current of the electric transformer.

19. The method of claim 15, wherein a minimum value of the first current drawn in the first period is less than a minimum load current of the electric transformer.

20. The method of claim 15, further comprising:

when the boost converter circuit operates in the current conducting mode and the boost output signal is greater than a first predetermined voltage, configuring the boost converter circuit to operate in the off mode.

21. The method of claim 15, further comprising:

when the boost converter circuit operates in the off mode and the boost output signal is less than a second predetermined voltage, configuring the boost converter circuit to operate in the current conducting mode.

* * * * *